US009891544B2

(12) United States Patent
Veregin et al.

(10) Patent No.: US 9,891,544 B2
(45) Date of Patent: Feb. 13, 2018

(54) TONER COMPOSITIONS WITH OPTIMIZED BETA-CARBOXYETHYL ACRYLATE SHELL LATEX FOR IMPROVED PARTICLE FORMATION AND MORPHOLOGY

(71) Applicant: XEROX CORPORATION, Norwalk, CT (US)

(72) Inventors: Richard P N Veregin, Mississauga (CA); Valerie M. Farrugia, Oakville (CA); Sandra J. Gardner, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/794,746

(22) Filed: Jul. 8, 2015

(65) Prior Publication Data

US 2017/0010553 A1 Jan. 12, 2017

(51) Int. Cl.
*G03G 9/093* (2006.01)
*G03G 9/08* (2006.01)

(52) U.S. Cl.
CPC ..... *G03G 9/09321* (2013.01); *G03G 9/0819* (2013.01); *G03G 9/0825* (2013.01); *G03G 9/09328* (2013.01); *G03G 9/09335* (2013.01); *G03G 9/09364* (2013.01); *G03G 9/09371* (2013.01)

(58) Field of Classification Search
CPC ..... G03G 9/09321; G03G 9/09364; G03G 9/09371
See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 4,298,672 | A | 11/1981 | Lu | |
| 4,338,390 | A | 7/1982 | Lu | |
| 6,063,827 | A | 5/2000 | Sacripante et al. | |
| 6,214,507 | B1 | 4/2001 | Sokol et al. | |
| 7,645,551 | B2 | 1/2010 | Sifain et al. | |
| 8,822,121 | B2 * | 9/2014 | Pang | G03G 9/09392 430/110.2 |
| 2006/0135650 | A1 * | 6/2006 | Moffat | C08F 257/02 523/201 |
| 2006/0166122 | A1 * | 7/2006 | Patel | G03G 9/0804 430/110.2 |
| 2007/0087280 | A1 * | 4/2007 | Patel | G03G 9/09321 430/110.2 |
| 2015/0056551 | A1 | 2/2015 | Schneider et al. | |
| 2015/0268573 | A1 * | 9/2015 | Iwazaki | G03G 9/08755 430/109.3 |
| 2016/0349643 | A1 * | 12/2016 | Saito | G03G 9/08755 |

* cited by examiner

*Primary Examiner* — Christopher D Rodee
(74) *Attorney, Agent, or Firm* — Pillsbury Winthrop Shaw Pittman LLP

(57) ABSTRACT

Disclosed herein include toner compositions with toner particles having a core-shell type structure, where the core comprises a first resin comprising a styrene-acrylate copolymer and an amorphous polyester resin, and the shell comprises a second resin comprising beta-carboxyethyl acrylate (b-CEA) in an amount of from about 0.05 pph to about 2.5 pph by weight of the second resin.

13 Claims, 6 Drawing Sheets

TONER COMPOSITIONS WITH OPTIMIZED BETA-CARBOXYETHYL ACRYLATE SHELL LATEX FOR IMPROVED PARTICLE FORMATION AND MORPHOLOGY

BACKGROUND

The present disclosure relates to toner compositions with toner particles having a core-shell type structure having an optimized beta-carboxyethyl shell. More particularly, embodiments herein relate to hybrid toner compositions.

Hybrid toners having some of the polyester resin latex replaced by a styrene/acrylate latex is a key in facilitating future cost reduction for certain toner products. For example, hybrid toners may contain a styrene/acrylate shell and a core comprising a styrene-acrylate copolymer and amorphous polyester. By replacing the polyester with more styrene/acrylate copolymer, the cost is reduced as polyester is traditionally a more expensive material. Not only are the polyester raw materials generally more expensive, but to prepare polyester latex to enable use in emulsion-aggregation toner requires an additional processing step, which often requires the use of solvents, verses styrene/acrylate copolymers can be directly prepared as a latex when the resin is prepared by emulsion polymerization. However, the process of preparing these hybrid toners is challenging because the preparation of the styrene/acrylate shell requires higher temperature for coalescence compared to the polyester in the core. For example, a polyester emulsion/aggregation toner prepared by a batch process is generally coalesced at temperatures from about 70° C. to about 85° C., for example, U.S. Patent Application Publication No. 2015/0056551, while a styrene/acrylate toner is generally coalesced at temperatures above 90° C., typically from 95 to 96° C., as for example in U.S. Pat. No. 7,645,551, herein included by reference.

A potential approach to address this mismatch is to elevate the coalescence temperature in the Emulsion Aggregation process to that typical from styrene/acrylates of about 95 to 96° C. However, depending on the Tg values of the styrene acrylate latex used in the shell, even with elevating the coalescence temperature may not be sufficient to enable a complete coalescence which leads to rough surface morphology of the toner particles, or may cause a loss of control of the toner particles during coalescence process resulting in poor particle properties, such as, toner particle size, toner particle shape, geometric size distribution (GSD), fines and coarse, as well as rejection of the styrene/acrylate latex, or rejection of other components, such as wax or pigment.

Thus, there exists a need to improve the coalescence of the styrene-acrylate to prepare hybrid toner particles. The inventors of the present disclosure discovered that by including only a small amount of beta-carboxyethyl acrylate in the resin latex in the shell can improve coalescence of the styrene-acrylate, while still maintaining sufficient beta-carboxyethyl acrylate in the resin latex in the shell to maintain control of the shell process.

SUMMARY

According to embodiments illustrated herein, there is provided a toner composition comprising core particles with a shell disposed over the core particles, wherein the core particles comprise a first resin comprising a styrene-acrylate copolymer; an amorphous polyester resin; optionally pigment; and optionally wax; and further wherein the shell comprises a second resin comprising beta-carboxyethyl acrylate (b-CEA) in an amount of from about 0.05 pph to about 2.5 pph by weight of the second resin.

In certain embodiments, there is provided a toner composition comprising core particles with a shell disposed over the core particles, wherein the core particles comprises a first resin comprising a styrene acrylate copolymer further comprising beta-carboxyethyl acrylate (b-CEA) in an amount of from about 3 pph to about 10 pph by weight of the first resin; and an amorphous polyester resin; and further wherein the shell comprises a second resin comprising a styrene acrylate copolymer comprises beta-carboxyethyl acrylate (b-CEA) in an amount of from about 0.5 pph to about 2.5 pph by weight of the second resin.

A toner composition comprising core particles with a shell disposed over the core particles, wherein the core particles comprises a first resin comprising a styrene acrylate polymer further comprising beta-carboxyethyl acrylate (b-CEA) in an amount of from about 1 pph to about 2 pph by weight of the first resin, wherein the first resin has a mean particle size of from about 100 nm to about 250 nm; and the second resin has a mean particle size of from about 100 nm to about 250 nm; an amorphous polyester resin; and further wherein the shell comprises a second resin comprising a styrene acrylate copolymer, wherein the second resin has a mean particle size of from about 80 nm to about 140 nm; beta-carboxyethyl acrylate (b-CEA) in an amount of from about 1 pph to about 2 pph by weight of the second resin.

BRIEF DESCRIPTION OF THE DRAWINGS

For a better understanding of the present embodiments, reference may be made to the accompanying figures.

DETAILED DESCRIPTION

Figure 1:
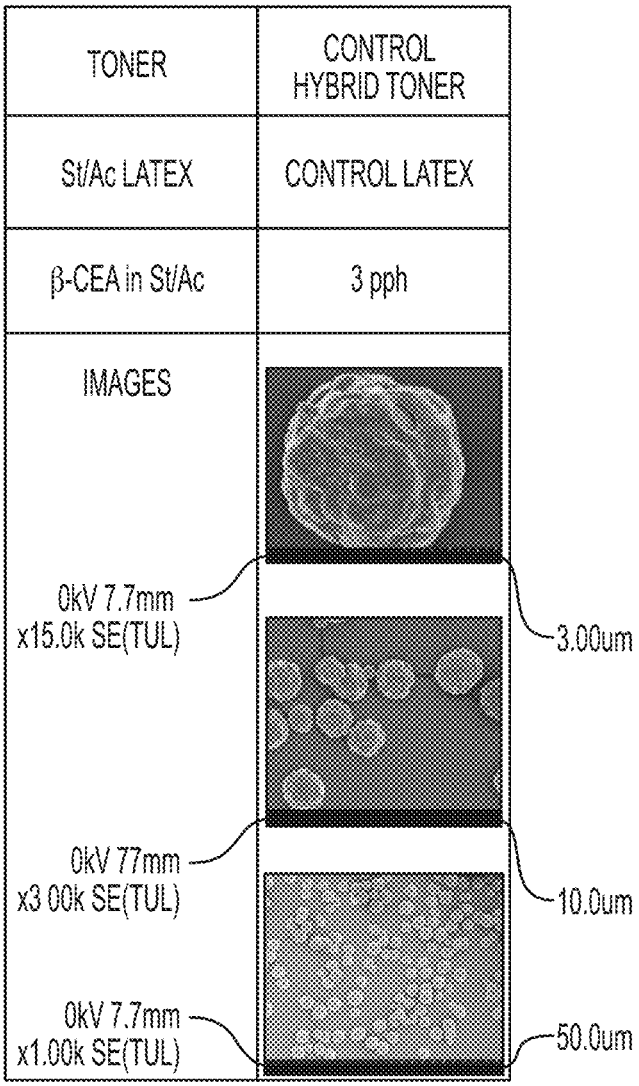
FIG. 1 shows scanning electron microscope (SEM) images at different magnifications (×15,000, ×3000, ×1000, from top to bottom) of toner surfaces of a Control Hybrid Toner.
Figure 2:
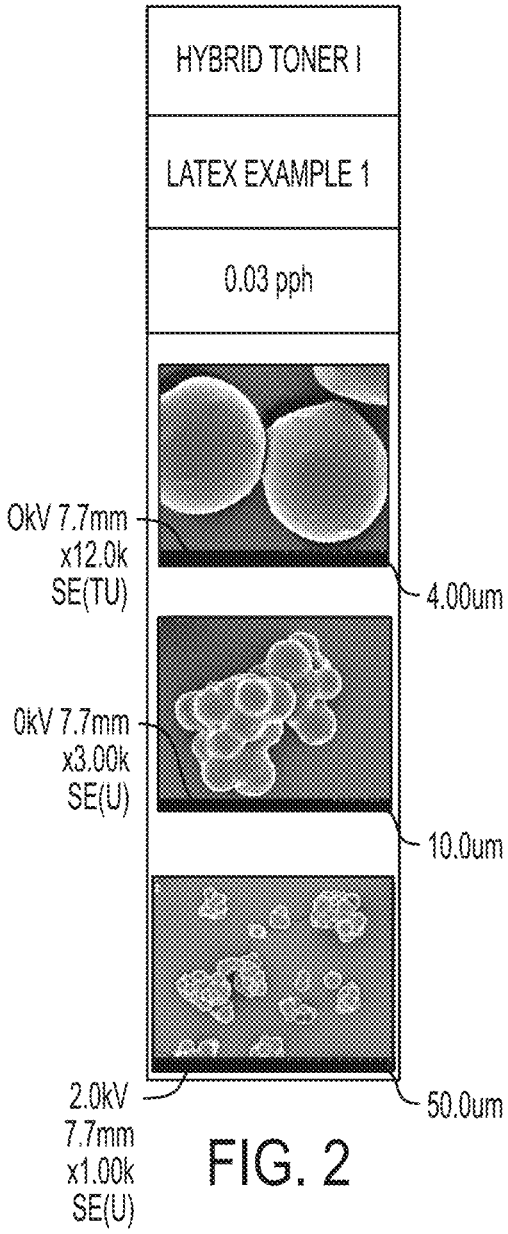
FIG. 2 shows scanning electron microscope (SEM) images at different magnifications (×12,000, ×3000, ×1000, from top to bottom) of toner surfaces of an inventive Hybrid Toners I according to embodiments of the present disclosure.
Figure 3:
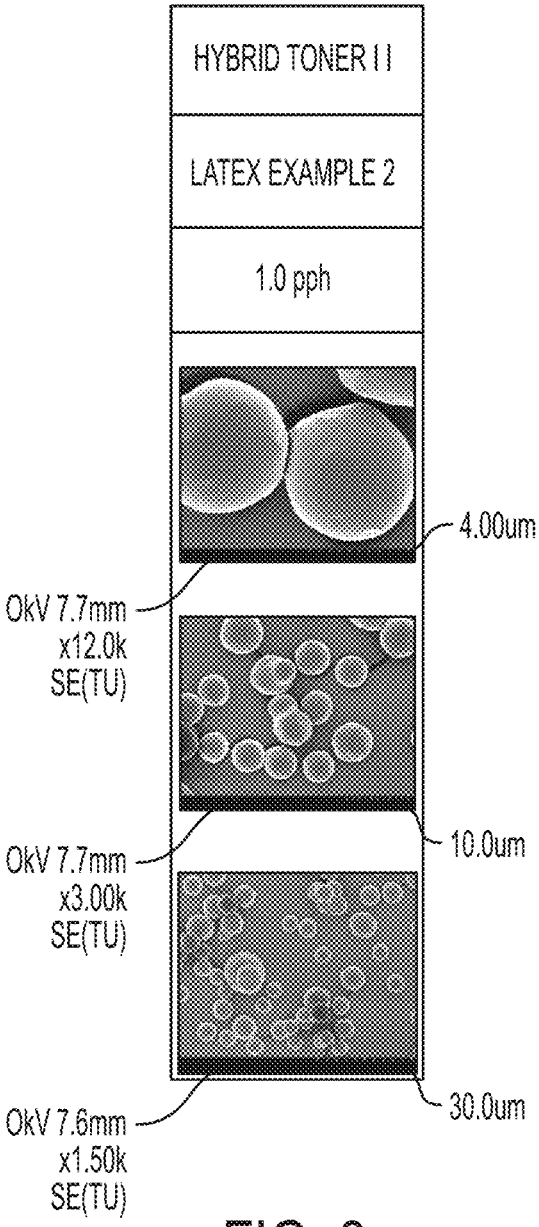
FIG. 3 shows scanning electron microscope (SEM) images at different magnifications (×12,000, ×3000, ×1500, from top to bottom) of toner surfaces of an inventive Hybrid Toners II according to embodiments of the present disclosure.
Figure 4:
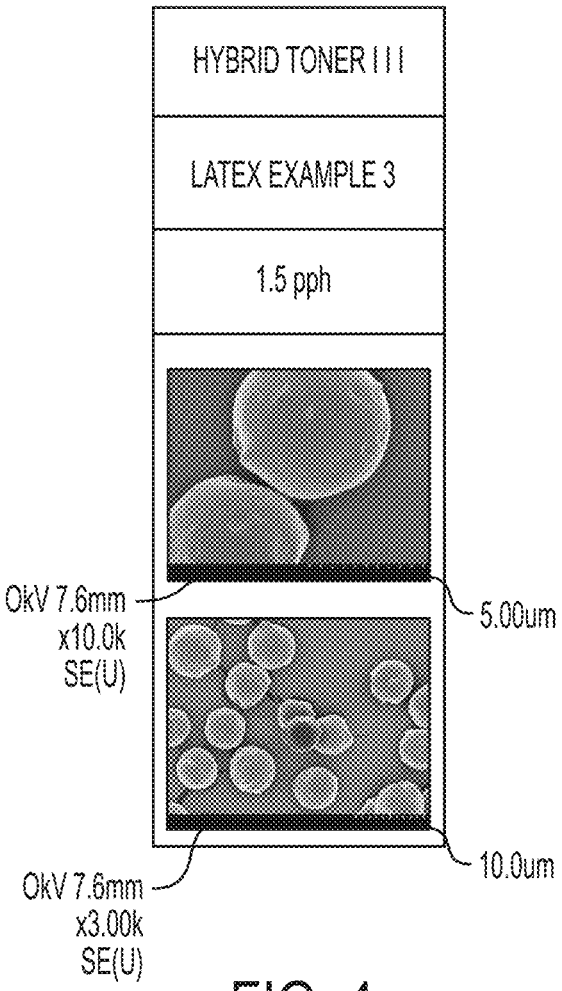
FIG. 4 shows scanning electron microscope (SEM) images at different magnifications (×10,000, ×3000, from top to bottom) of toner surfaces of an inventive Hybrid Toners III according to embodiments of the present disclosure.
Figure 5:
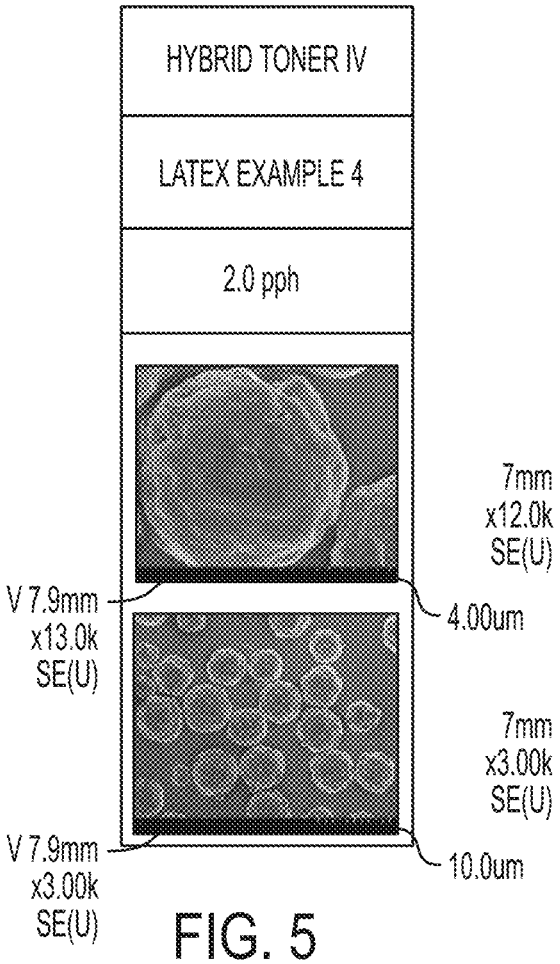
FIG. 5 shows scanning electron microscope (SEM) images at different magnifications (×13,000, ×3000, from top to bottom) of toner surfaces of an inventive Hybrid Toners IV according to embodiments of the present disclosure.
Figure 6:
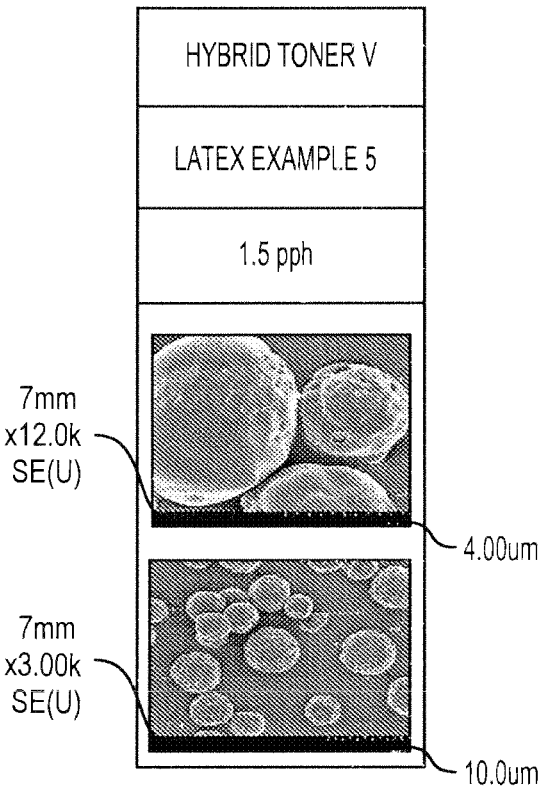
FIG. 6 shows scanning electron microscope (SEM) images at different magnifications (×12,000, ×3000, from top to bottom) of toner surfaces of an inventive Hybrid Toners V according to embodiments of the present disclosure.

In the following description, it is understood that other embodiments may be utilized and structural and operational changes may be made without departure from the scope of the present embodiments disclosed herein.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

The present disclosure provides a toner having a core and a shell, wherein the core comprises a first resin comprising a styrene acrylate copolymer, and an amorphous resin, and the shell comprises a second resin comprising beta-carboxyethyl acrylate (also named as 3-(prop-2-enoyloxy)propanoic acid, or b-CEA or β-CEA) in an amount of from about 0.05 pph to about 2.5 pph by weight of the shell. The second resin may also comprise a styrene acrylate copolymer.

The toner of the present disclosure can be prepared by emulsion aggregation (EA). This small amount of β-CEA (i.e., 0.05 pph to 2.5 pph) present in the shell is critical and is found to be the optimal amount for the EA process, which helps improve the resin flow in the toner coalescence. Without the presence of β-CEA in the shell may result in poor toner particle properties in respects to size, GSD, fines, and coarse. With more than 2.5 pph of β-CEA present in the shell may cause the coalescence process to be too slow for the shell latex resulting in poor toner particle properties, such as a rough and incomplete shell that does not encompass the entire toner particle.

In embodiments, the amount of β-CEA present in the second resin in the shell may be from about 1 pph to about 2 pph, from about 0.3 pph to about 1.7 pph, or from about 0.5 pph to about 1.5 pph by weight of the second resin.

In embodiments, the amount of β-CEA present in the first resin in the core may be from about 0 pph to about 10 pph of β-CEA by weight of the first resin, such as from about 3 pph to about 10 pph, from about 3 pph to about 8 pph, or from about 3 pph to about 5 pph by weight of the first resin. In one embodiment, no β-CEA is present in the first resin. The first resin may contain a lower amount of β-CEA, such as less than 3 pph by weight of the first resin, or having the same β-CEA content as in the second resin, or a higher β-CEA amount than that in the second resin. However, to avoid over spherodization of the core, it may not be desirable to improve the flow of the core latex in the core by lowering the amount of β-CEA present in the core. For example if the Tg and molecular weight of the first resin in the core is relatively low, lower β-CEA in the core may result in overspherodization of the core of the toner for embodiments where a non-spherical toner is desired. The term "spherodization" means that the overall toner particle circularity increases. It is desired that the circularity can be controlled, in embodiments within the range of about 0.93 and about 0.99. However, if the coalescence of the core is too rapid, then the circularity of the toner particle may not be easily controlled as it grows too rapidly. In a production scale, it is desirable that the target circularity of the toner particle to be reached within the time frame of from about 90 minutes to about 4 hours. If the coalescence process is faster than 90 minutes it may be difficult to monitor and stop the circularity increase. On the other hand, if the coalescence process is longer than 4 hours, then toner production throughput may suffer.

In embodiments, the amount of β-CEA in the first resin is higher than the amount of β-CEA in the second resin. In embodiments, the amount of β-CEA in the first resin is lower than the amount of β-CEA in the second resin.

The first and second resins may be the same or different. Illustrative examples of specific polymers for the first and second resins include, for example, poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly (alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), poly(styrene-1,3-diene), poly (styrene-1,3-diene-acrylic acid), poly (styrene-1,3-diene-acrylonitrile-acrylic acid), poly(styrene-butadiene), poly (methylstyrene-butadiene), poly (styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl methacrylate-acrylic acid), poly(butyl methacrylate-butyl acrylate), poly (butyl methacrylate-acrylic acid), poly(acrylonitrile-butyl acrylate-acrylic acid), and mixtures thereof. The alkyl group in the aforementioned polymers may be any alkyl group, and in particular may be a $C_1$-$C_{12}$ alkyl group, for example including methyl, ethyl, propyl and butyl. As the aryl group, any aryl group known in the art may be used.

In embodiments, the first resin and the second resin may be, independently, styrene-alkyl acrylate, more particularly a styrene-butyl acrylate polymer such as a styrene-butyl acrylate polymer.

In embodiments, the first resin and the second resin each include a styrene monomer and an acrylic monomer. In embodiments, the first resin further comprises at least one cross-linker. In embodiments, the second resin further comprises at least one cross-linker.

As used herein, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

As used herein, the term "acrylic acid monomer" refers to acrylic acid, methacrylic acid, and β-CEA. As used herein, the term "acrylic ester monomer" refers to esters of acrylic acid and methacrylic acid. Acrylic ester monomers include, but are not limited to, butyl acrylate, butyl methacrylate, propyl acrylate, propyl methacrylate, ethyl acrylate, ethyl methacrylate, methyl acrylate and methyl methacrylate. In certain embodiments, the acrylic ester monomer is n-butyl acrylate.

In embodiments, the styrene monomer is present in the core in an amount of from about 30 to about 90, or from about 70 to about 90 weight percent by weight of the core resin.

In embodiments, the acrylic ester monomer is present in the core in an amount of from about 10 to about 70, or from about 10 to about 30 weight percent by weight of the core resin.

In embodiments, the styrene monomer is present in the shell in an amount of from about 30 to about 90, or from about 70 to about 90 weight percent by weight of the shell.

In embodiments, the acrylic ester monomer is present in the shell in an amount of from about 10 to about 70, or from about 10 to about 30 weight percent by weight of the shell.

In embodiments, the first resin includes styrene and n-butyl acrylate.

In embodiments, the second resin includes styrene and n-butyl acrylate.

The first resin may have a mean particle size of from about 100 nm to about 250 nm, from about 100 nm to about 140 nm, from about 140 nm to about 200 nm, or from about 140 to about 250 nm.

The second resin may have a mean particle size of from about 100 nm to about 250 nm, from about 100 nm to about 140 nm, from about 140 nm to about 200 nm, or from about 140 to about 250 nm.

Amorphous Polyester Resin

The toner composition of the present disclosure include core particles comprises an amorphous polyester resin. The amorphous polyester resin may be formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin. In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

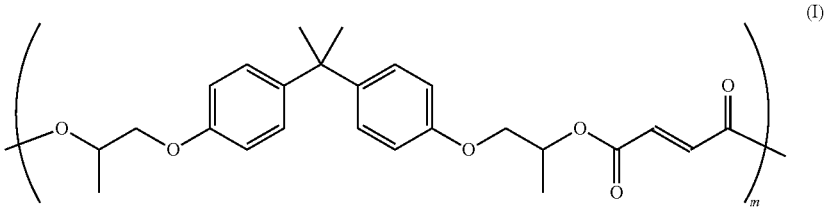

(I)

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

In embodiments, the resins utilized as the resin coating may have a glass transition temperature of from about 30° C. to about 80° C., in embodiments from about 35° C. to about 70° C. In further embodiments, the resins utilized as the resin coating may have a melt viscosity of from about 10 to about 1,000,000 Pa*S at about 130° C., in embodiments from about 20 to about 100,000 Pa*S.

Crystalline Polyester Resin

The crystalline resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly (propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylenesebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Optional Additives

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin described above or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with the shell resin described above or after application of the shell resin.

The toner particles of the present embodiments exhibits a dielectric loss of about 10 to about 45, from about 5 to about 35, or from about 5 to about 60. The toner particles of the present embodiments exhibits a gloss from about 10 ggu to about 60 ggu, from about 20 ggu to about 70 ggu, or from about 30 ggu to about 70 ggu on plain paper The toner particles of the present embodiments have an average particle size of from about 4 μm to about 10 μm, from about 4 μm to about 7 μm, or from about 4 μm to about 20 μm The toner particles of the present embodiments have an average circularity of from about 0.93 to about 0.99, from about 0.96 to about 0.98, or from about 0.95 to about 0.99. The toner particles of the present embodiments have a shape factor of from about 120 to about 140, from about 110 to about 130, or from about 105 to about 150. The toner particles of the present embodiments have a volume geometric standard deviation for (D84/D50) in the range of from about 1.15 to about 1.25, from about 1.15 to about 1.30, or from about 1.20 to about 1.25. The toner particles of the present embodiments have a number geometric standard deviation for (D16/D50) in the range of from about 1.15 to about 1.25, from about 1.15 to about 1.30, or from about 1.20 to about 1.25.

Specific embodiments will now be described in detail. These examples are intended to be illustrative, and the claims are not limited to the materials, conditions, or process parameters set forth in these embodiments. All parts and percentages are by weight unless otherwise indicated.

Example 1

Preparation of Polystyrene-Co-n-Butyl Acrylate) Latex with 0.03 pph Beta-CEA (Latex Example 1)

A latex emulsion comprised of polymer particles generated from the emulsion polymerization of styrene, n-butyl acrylate, and beta-carboxyethyl acrylate (βCEA) was prepared as follows.

A surfactant solution of 1.02 grams Dowfax™ 2A1 (anionic alkyldiphenyloxide disulfonate surfactant; The Dow Chemical Company) and 273.5 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 410 rpm. The reactor was then heated up to 80° C. at a controlled rate, and held there. Separately, 4.79 grams of ammonium persulfate initiator was dissolved in 43.6 grams of de-ionized water.

Separately, the monomer emulsion was prepared in the following manner. 244.1 g of styrene, 75.0 g of butyl acrylate, 0.10 g of beta-CEA and 2.18 g of 1-dodecanethiol (DDT) and 1.12 g of 1,10-decanediol diacrylate (ADOD) were added to a premix of 5.77 of Dowfax 2A1 in 146.51 g of deionized water were mixed to form an emulsion. Five percent of the above emulsion (23.74 g) was then slowly dropped into the reactor containing the aqueous surfactant phase at 80° C. to form the "seeds" while being purged with nitrogen. The initiator solution was then slowly charged into the reactor. The monomer emulsion was split into two aliquots; 213.6 g of the monomer emulsion was initially feed into the reactor at 1.70 g/min. The second aliquot of 216.0 g monomer emulsion was mixed with 2.36 g of DDT and added to the reactor at 2.40 g/min. Once all the monomer emulsion was charged into the main reactor, the temperature was held at 80° C. for an additional 3 hours, followed by a finishing step of heating at 86.0° C. for 4 hours to enable high conversion of monomer to polymer. Full cooling was then applied and the reactor temperature was reduced to 25° C. The product was collected into a holding tank and sieved with a 25 μm screen. The particle size was then measured by Nanotrac® U2275E particle size analyzer to have a D50 of 149 nm.

Example 2

Preparation of Polystyrene-Co-n-Butyl Acrylate) Latex with 1.0 pph Beta-CEA (Latex Example 2)

A latex emulsion comprised of polymer particles generated from the emulsion polymerization of styrene, n-butyl acrylate, and beta-carboxyethyl acrylate (βCEA) was prepared as follows.

A surfactant solution of 1.13 grams Dowfax™ 2 A1 (anionic alkyldiphenyloxide disulfonate surfactant; The Dow Chemical Company) and 307.8 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 360 rpm. The reactor was then heated up to 80° C. at a controlled rate, and held there. Separately, 5.30 grams of ammonium persulfate initiator was dissolved in 49.1 grams of de-ionized water.

Separately, the monomer emulsion was prepared in the following manner. 272.3 g of styrene, 81.3 g of butyl acrylate, 3.54 g of beta-CEA and 4.84 g of 1-dodecanethiol (DDT) and 1.24 g of 1,10-decanediol diacrylate (ADOD) were added to a premix of 6.39 of Dowfax 2A1 in 164.88 g of deionized water were mixed to form an emulsion. Five percent of the above emulsion (26.70 g) was then slowly dropped into the reactor containing the aqueous surfactant phase at 80° C. to form the "seeds" while being purged with nitrogen. The initiator solution was then slowly charged into the reactor. The monomer emulsion was split into two aliquots; 240.5 g of the monomer emulsion was initially feed into the reactor at 1.95 g/min. The second aliquot of 242.7 g monomer emulsion was mixed with 2.23 g of DDT and added to the reactor at 2.70 g/min. Once all the monomer emulsion was charged into the main reactor, the temperature was held at 80° C. for an additional 3 hours, followed by a finishing step of heating at 82.0° C. for 1 hour and then 4 hours at 84° C. to enable high conversion of monomer to polymer. Full cooling was then applied and the reactor temperature was reduced to 25° C. The product was collected into a holding tank and sieved with a 25 μm screen. The particle size was then measured by Nanotrac® U2275E particle size analyzer to have a D50 of 224 nm.

Example 3

Preparation of Polystyrene-Co-n-Butyl Acrylate) Latex with 1.5 pph Beta-CEA (Latex Example 3)

A latex emulsion comprised of polymer particles generated from the emulsion polymerization of styrene, n-butyl acrylate, and beta-carboxyethyl acrylate (βCEA) was prepared as follows.

A surfactant solution of 1.12 grams Dowfax 2A1 (anionic alkyldiphenyloxide disulfonate surfactant; The Dow Chemical Company) and 307.8 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 380 rpm. The reactor was then heated up to 80° C. at a controlled rate, and held there. Separately, 5.28 grams of ammonium persulfate initiator was dissolved in 49.09 grams of de-ionized water.

Separately, the monomer emulsion was prepared in the following manner. 279.75 g of styrene, 72.14 g of butyl acrylate, 5.28 g of beta-CEA and 4.82 g of 1-dodecanethiol (DDT) and 1.23 g of 1,10-decanediol diacrylate (ADOD) were added to a premix of 6.39 of Dowfax 2A1 in 164.90 g of deionized water were mixed to form an emulsion. Five percent of the above emulsion (26.72 g) was then slowly dropped into the reactor containing the aqueous surfactant phase at 80° C. to form the "seeds" while being purged with nitrogen. The initiator solution was then slowly charged into the reactor. The monomer emulsion was split into two aliquots; 240.52 g of the monomer emulsion was initially feed into the reactor at 1.95 g/min. The second aliquot of 242.74 g monomer emulsion was mixed with 2.22 g of DDT and added to the reactor at 2.70 g/min. Once all the monomer emulsion was charged into the main reactor, the temperature was held at 80° C. for an additional 3 hours, followed by a finishing step of heating at 82.0° C. for 1 hour and then 4 hours at 84° C. to enable high conversion of monomer to polymer. Full cooling was then applied and the reactor temperature was reduced to 25° C. The product was collected into a holding tank and sieved with a 25 μm screen. The particle size was then measured by Nanotrac® U2275E particle size analyzer to have a D50 of 171.5 nm.

Example 4

Preparation of Polystyrene-Co-n-Butyl Acrylate) Latex with 2.0 pph Beta-CEA (Latex Example 4)

A latex emulsion comprised of polymer particles generated from the emulsion polymerization of styrene, n-butyl acrylate, and beta-carboxyethyl acrylate (βCEA) was prepared as follows:

A surfactant solution of 1.11 grams Dowfax 2A1 (anionic alkyldiphenyloxide disulfonate surfactant; the Dow Chemical Company) and 307.9 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 340 rpm. The reactor was then heated up to 80° C. at a controlled rate, and held there. Separately, 5.23 grams of ammonium persulfate initiator was dissolved in 49.10 grams of de-ionized water.

Separately, the monomer emulsion was prepared in the following manner. 273.60 g of styrene, 74.93 g of butyl acrylate, 6.97 g of beta-CEA and 5.23 g of 1-dodecanethiol (DDT) and 1.22 g of 1,10-decanediol diacrylate (ADOD) were added to a premix of 6.30 of Dowfax 2A1 in 164.94 g of deionized water were mixed to form an emulsion. Five percent of the above emulsion (26.66 g) was then slowly dropped into the reactor containing the aqueous surfactant phase at 80° C. to form the "seeds" while being purged with nitrogen. The initiator solution was then slowly charged into the reactor. The monomer emulsion was split into two aliquots; 239.94 g of the monomer emulsion was initially feed into the reactor at 1.94 g/min. The second aliquot of 239.94 g monomer emulsion was mixed with 3.48 g of DDT and added to the reactor at 2.70 g/min. Once all the monomer emulsion was charged into the main reactor, the temperature was held at 80° C. for an additional 3 hours, followed by a finishing step of heating at 82.0° C. for 1 hour and then 4 hours at 84 C to enable high conversion of monomer to polymer. Full cooling was then applied and the reactor temperature was reduced to 25° C. The product was collected into a holding tank and sieved with a 25 μm screen. The particle size was then measured by Nanotrac® U2275E particle size analyzer to have a D50 of 153.7 nm.

Example 5

Preparation of Polystyrene-Co-n-Butyl Acrylate) Latex with 1.5 pph Beta-CEA (Latex Example 5)

A latex emulsion comprised of polymer particles generated from the emulsion polymerization of styrene, n-butyl acrylate, and beta-carboxyethyl acrylate (βCEA) was prepared as follows.

A surfactant solution of 1.12 grams Dowfax 2A1 (anionic alkyldiphenyloxide disulfonate surfactant; The Dow Chemical Company) and 307.8 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 342 rpm. The reactor was then heated up to 80° C. at a controlled rate, and held there. Separately, 5.28 grams of ammonium persulfate initiator was dissolved in 49.09 grams of de-ionized water.

Separately, the monomer emulsion was prepared in the following manner. 279.75 g of styrene, 72.14 g of butyl acrylate, 5.28 g of beta-CEA and 4.82 g of 1-dodecanethiol (DDT) and 1.23 g of 1,10-decanediol diacrylate (ADOD) were added to a premix of 6.39 of Dowfax 2A1 in 164.90 g of deionized water were mixed to form an emulsion. Five percent of the above emulsion (26.72 g) was then slowly dropped into the reactor containing the aqueous surfactant phase at 80° C. to form the "seeds" while being purged with nitrogen. The initiator solution was then slowly charged into the reactor. The monomer emulsion was split into two aliquots; 240.52 g of the monomer emulsion was initially feed into the reactor at 1.94 g/min. The second aliquot of 240.52 g monomer emulsion was mixed with 2.22 g of DDT and added to the reactor at 2.70 g/min. Once all the monomer emulsion was charged into the main reactor, the temperature was held at 80° C. for an additional 3 hours, followed by a finishing step of heating at 82.0° C. for 1 hour and then 4 hours at 84 C to enable high conversion of monomer to polymer. Full cooling was then applied and the reactor temperature was reduced to 25° C. The product was collected into a holding tank and sieved with a 25 μm screen. This latex was then reheated to 85.0° C. for 10 hours to further reduce the residual monomer that was left unreacted. The product was sieved again with a 25 μm screen. The particle size was then measured by Nanotrac® U2275E particle size analyzer to have a D50 of 183.9 nm.

Latex Formulation and Properties

Table 1 below summarizes the ingredients used in the preparation of latexes in Examples 1-5 and the properties of the latexes.

TABLE 1

| Latex Type | Example 1 | Example 2 | Example 3 | Example 4 | Example 5 |
|---|---|---|---|---|---|
| Styrene (%) | 76.5 | 77 | 79.5 | 78.5 | 79.5 |
| n-butyl acrylate (nBA) (%) | 23.5 | 23 | 20.5 | 21.5 | 20.5 |
| bCEA (pph)* | 0.03 | 1.00 | 1.50 | 2.00 | 1.50 |
| 1,10-decanediol diacrylate (ADOD) (pph)* | 0.35 | 0.35 | 0.35 | 0.35 | 0.35 |
| 1-dodecanethiol (1st addition) (DDT#1) (pph)* | 0.683 | 1.370 | 1.370 | 1.500 | 1.370 |
| 1-dodecanethiol (2nd addition) (DDT#2) (pph)* | 2.161 | 2.630 | 2.630 | 3.500 | 2.630 |
| DOWFAX ™ (pph)* | 1.00 | 1.00 | 1.00 | 1.00 | 1.00 |
| Ammonium persulfate (APS) (pph)* | 1.50 | 1.50 | 1.50 | 1.50 | 1.50 |
| DOWFAX ™ partition | 15/85 | 15/85 | 15/85 | 15/85 | 15/85 |
| Seed % | 5.0 | 5.0 | 5.0 | 5.0 | 5.0 |
| Particle Size $D_{50}$ (nm) | 149.0 | 223.9 | 171.5 | 153.7 | 183.9 |
| Particle Size $D_{95}$ (nm) | 208.6 | 318.0 | 246.2 | 218.6 | 281.5 |
| Zeta Potential (mV) ± Zeta Dev. | −66.4 ± 9.73 | −62.8 ± 9.00 | −64.5 ± 12.1 | −66.8 ± 12.4 | −49.8 ± 22.5 |
| Solids (%) | 37.10 | 39.32 | 36.38 | 40.58 | 41.18 |
| Mw (k) | 48.5 | 23.9 | 32.6 | 21.8 | 32.4 |
| Mn (k) | 8.9 | 10.0 | 7.8 | 7.1 | 7.8 |
| PDI (polydispersity) | 5.43 | 2.40 | 4.15 | 3.07 | 4.15 |
| Tg (° C.) - Onset | 51.30 | 47.13 | 53.31 | 47.69 | 51.34 |
| Tg (° C.) - Midpoint | 55.31 | 51.79 | 56.70 | 52.67 | 55.68 |

TABLE 1-continued

| Latex Type | Example 1 | Example 2 | Example 3 | Example 4 | Example 5 |
|---|---|---|---|---|---|
| Tg (° C.) - Offset | 59.32 | 56.44 | 60.10 | 57.64 | 60.01 |
| Acid Value (titration) | 6.98 | 5.12, 17.26 | 4.82, 15.70 | 4.31, 18.71 | 5.82, 17.11 |
| Styrene (ppm) in latex | 259 | 367 | 778 | 90.5 | 535.07 |
| nBA (ppm) in latex | 90 | 79 | 103 | 12.4 | 59.43 |

*weight parts per hundred parts of total weight of styrene and n-butyl acrylate.

Example 6A

Preparation of Control Hybrid Toner Containing 3 pph β-CEA Latex

In a 2 L reactor, 94.12 g of amorphous polyester emulsion A (having an Mw of about 19,400, an Mn of about 5,000, a Tg onset of about 60° C., and about 35% solids), 94.12 g of amorphous polyester emulsion B (having an average molecular weight (Mw) of about 86,000, a number average molecular weight (Mn) of about 5,600, an onset glass transition temperature (Tg onset) of about 56° C., and about 35% solids;), 18.76 g styrene-acrylate latex C (an emulsion polymerized latex of about 200 nm size with 76.5% styrene and 23.5% nBA, a Mw of 35,000 and a Tg onset of about 51° C., and about 40% solids.) which contains 3 pph beta-CEA, 29.16 g crystalline polyester emulsion D (having an Mw of about 23,300, an Mn of about 10,500, a melting temperature of about 71° C. and about 35.4% solids), 45.94 g polyethylene wax emulsion E (having a Tm of about 90° C., and about 30% solids); 9.55 g cyan pigment (PB15:3), 57.60 g black pigment (Nipex-35) and 449.51 g deionized water (DI) water were combined to form a slurry. Then, a mixture of 2.69 g of PAC (poly-aluminum chloride) and 33.21 g of 0.02M nitric acid was added to the slurry under homogenization at 3000-4000 RPM and the pH was adjusted from 5.46 to 3.49 with 0.3M nitric acid. The reactor was set to 265 RPM and was heated to 45° C. to aggregate the toner particles. When the size of the toner particles reached 4.8-5 μm, a shell coating was added which contains 106.77 g of styrene-acrylate latex C. The reaction was further heated to 50° C. When the toner particle size reached 5.6-6 microns, freezing began with the pH of the slurry being adjusted to 4.59 using 9.91 g of a 4% NaOH solution. The reactor RPM was decreased to 160 followed by the addition of 5.77 g of a chelating agent (Versene 100) and 3.70 g of a 4% NaOH solution until pH reached 7.64. The reactor temperature was ramped to 78° C. Once at 78° C., the pH of the slurry was reduced from 7.16 to 5.12 with 67.02 g of 0.3M nitric acid. The reactor temperature was further ramped to 86° C. Once at the coalescence temperature, the slurry was coalesced for about 20 minutes until the particle circularity was between 0.955-0.960 as measured by the Flow Particle Image Analysis (FPIA) instrument. The slurry was then quench cooled in 750 g of ice prepared from deionized water. The final particle size was 5.96 microns, GSDv 1.201, GSDn 1.233 and a circularity of 0.974. The toner was then washed and freeze-dried.

Example 6B

Hybrid Toner I Prepared from Latex Example 1

In a 2 L reactor, 94.12 g of amorphous polyester emulsion A, 94.12 g of amorphous polyester emulsion B, 20.30 g poly(styrene-co-n-butyl acrylate) latex with 0.03 pph beta-CEA (Latex Example 1), 29.16 g crystalline polyester emulsion D, 45.94 g polyethylene wax emulsion E, 9.55 g cyan pigment (PB15:3), 57.60 g black pigment (Nipex-35) and 447.97 g DI water were combined to form a slurry. Then, a mixture of 2.69 g of PAC (poly-aluminum chloride) and 33.21 g 0.02M nitric acid was added to the slurry under homogenization at 3000-4000 RPM and the pH was adjusted from 5.50 to 3.02 with 0.3M nitric acid. The reactor is set to 246 RPM and is heated to 45° C. to aggregate the toner particles. When the size reaches 4.8-5 μm, a shell coating was added which contains 115.55 g styrene-acrylate latex with 0.03 pph beta-CEA (Latex Example 1). The reaction was further heated to 50° C. When the toner particle size reached 5.6-6 microns, freezing began with the pH of the slurry being adjusted to 4.98 using 11.96 g of a 4% NaOH solution. The reactor RPM was decreased to 175 followed by the addition of 5.77 grams of a chelating agent (Versene 100) pH reached 8.01. The reactor temperature was ramped to 75° C. Once at 75° C., the pH of the slurry was reduced from 7.32 to 5.11 with 28.30 g 0.3M nitric acid. The reactor temperature was further ramped to 92° C. Once at the coalescence temperature, the slurry was coalesced for about 60 minutes until the particle circularity was between 0.955-0.960 as measured by the Flow Particle Image Analysis (FPIA) instrument. The slurry was then quench cooled in 760 g of ice prepared from deionized water. The final particle size was 14.35 microns, GSDv 1.362, GSDn 1.689 and a circularity of 0.944. The toner was then washed and freeze-dried.

Example 7

Hybrid Toner II Prepared from Latex Example 2

In a 2 L reactor, 94.12 g of amorphous polyester emulsion A), 94.12 g of amorphous polyester emulsion B, 20.79 g poly(styrene-co-n-butyl acrylate) latex with 1.0 pph beta-CEA (VF878 Latex Example 2), 29.16 g crystalline polyester emulsion D, 45.94 g polyethylene wax emulsion E, 9.55 g cyan pigment (PB15:3), 57.60 g black pigment (Nipex-35) and 443.70 g DI water were combined. Then, a mixture of 2.70 g of PAC (poly-aluminum chloride) mixed with 33.30 g 0.02M nitric acid was added to the slurry under homogenization at 3000-4000 RPM and the pH was adjusted from 5.50 to 2.99 with 0.3M nitric acid. The reactor was set to 272 RPM and was heated to 45° C. to aggregate the toner particles. When the size reached 4.8-5 μm, a shell coating was added which consists of 118.29 g styrene-acrylate latex with 1.0 pph beta-CEA (VF878 Latex Example 2). The reaction was held at 45° C. When the toner particle size reaches reached 5.6-6 microns, freezing began with the pH of the slurry being adjusted to 5.51 using 14.14 g of a 4% NaOH solution. The reactor RPM was decreased to 183 followed by the addition of 5.77 grams of a chelating agent (Versene 100) pH reaches reached 8.38. The reactor temperature was ramped to 71° C. Once at 71° C., the pH of the slurry was reduced from 7.69 to 4.37 with 54.18 g 0.3M nitric acid. The reactor temperature was further ramped to 86° C. and reactor RPM was held at 185. Once at the coalescence temperature, the slurry was coalesced for about 85 minutes until the particle circularity was between 0.965-0.975 as measured by the Flow Particle Image Analysis (FPIA) instrument. The slurry was then quench cooled in 677.5 g of ice prepared from deionized water ice. The final particle size was 6.61 microns, GSDv 1.226, GSDn 1.207 and a circularity of 0.988. The toner was then washed and freeze-dried.

Example 8 Hybrid Toner III Prepared from Latex Example 3 with 1.5 pph Beta-CEA

In a 2 L reactor, 94.12 g of amorphous polyester emulsion A, 94.12 g of amorphous polyester emulsion B, 20.71 g poly(styrene-co-n-butyl acrylate) latex with 1.5 pph beta-CEA (Latex Example 3), 29.16 g crystalline polyester emulsion D, 45.94 g polyethylene wax emulsion E, 9.55 g cyan pigment (PB15:3), 57.60 g black pigment (Nipex-35) and 447.56 g DI water were combined. Then, a mixture of 2.69 g of PAC (poly-aluminum chloride) mixed with 33.21 g 0.02M nitric acid was added to the slurry under homogenization at 3000-4000 RPM and the pH was adjusted from 5.50 to 2.57 with 0.3M nitric acid. The reactor was set to 285 RPM and was heated to 44° C. to aggregate the toner particles. When the size reached 4.8-5 μm, the RPM was reduced to 261 and a shell coating was added which consists of 117.84 g styrene-acrylate latex with 1.5 pph beta-CEA (Latex Example 3). The reaction was held at 44° C. When the toner particle size reached 5.6-6 microns, freezing began with the pH of the slurry being adjusted to 4.81 using 14.88 g of a 4% NaOH solution. The reactor RPM was decreased to 214 followed by the addition of 5.77 grams of a chelating agent (Versene 100) pH reaches reached 7.43. The reactor temperature was ramped to 73° C. Once at 73° C., the pH of the slurry was reduced from 7.12 to 4.41 with 29.72 g 0.3M nitric acid. The reactor temperature was further ramped to 88° C. and reactor RPM was held at 217. Once at the coalescence temperature, the slurry was coalesced for about 115 minutes until the particle circularity was between 0.965-0.975 as measured by the Flow Particle Image Analysis (FPIA) instrument. The slurry was then quench cooled in 812.2 g of ice prepared from deionized water ice. The final particle size was 6.48 microns, GSDv 1.226, GSDn 1.214 and a circularity of 0.985. The toner was then washed and freeze-dried.

Example 9. Hybrid Toner IV Prepared from Latex Example 4 with 2.0 pph Beta-CEA

In a 2 L reactor, 94.12 g of amorphous polyester emulsion A, 94.12 g of amorphous polyester emulsion B), 18.56 g poly(styrene-co-n-butyl acrylate) latex with 2.0 pph beta-CEA (Latex Example 4), 29.16 g crystalline polyester emulsion D, 45.94 g polyethylene wax emulsion E, 9.55 g cyan pigment (PB15:3), 57.60 g black pigment (Nipex-35) and 449.71 g DI water were combined. Then, a mixture of 2.69 g of PAC (poly-aluminum chloride) mixed with 33.21 g 0.02M nitric acid was added to the slurry under homogenization at 3000-4000 RPM and the pH was adjusted from 5.50 to 3.20 with 0.3M nitric acid. The reactor was set to 273 RPM and was heated to 44° C. to aggregate the toner particles. When the size reached 4.8-5 μm, the RPM was reduced to 237 and a shell coating was added which consists of 105.64 g styrene-acrylate latex with 2.0 pph beta-CEA (Latex Example 4). The reaction was held at 44° C. When the toner particle size reached 5.6-6 microns, freezing began with the pH of the slurry being adjusted to 4.73 using 8.93 g of a 4% NaOH solution. The reactor RPM was decreased to 193 followed by the addition of 5.77 grams of a chelating agent (Versene 100) pH reaches reached 7.66. The reactor temperature was ramped to 70° C. Once at 70° C., the pH of the slurry was reduced from 7.12 to 4.55 with 44.73 g 0.3M nitric acid. The reactor temperature was further ramped to 85° C. and reactor RPM was held at 193. Once at the coalescence temperature, the slurry was coalesced for about 14 minutes until the particle circularity was between 0.965-0.975 as measured by the Flow Particle Image Analysis (FPIA) instrument. The slurry was then quench cooled in 900 g of ice prepared from deionized water ice. The final particle size was 5.48 microns, GSDv 1.21, GSDn 1.21 and a circularity of 0.985. The toner was then washed and freeze-dried.

Example 10. Hybrid Toner V Prepared from Latex Example 5 with 1.5 pph Beta-CEA

In a 2 L reactor, 94.12 g of amorphous polyester emulsion A, 94.12 g of amorphous polyester emulsion B, 18.67 g poly(styrene-co-n-butyl acrylate) latex with 1.5 pph beta-CEA (Latex Example 5), 29.16 g crystalline polyester emulsion D, 45.94 g polyethylene wax emulsion E, 9.55 g cyan pigment (PB15:3), 57.60 g black pigment (Nipex-35) and 449.60 g DI water were combined. Then, a mixture of 2.69 g of PAC (poly-aluminum chloride) mixed with 33.21 g 0.02M nitric acid was added to the slurry under homogenization at 3000-4000 RPM and the pH was adjusted from 4.20 to 3.14 with 0.3M nitric acid. The reactor was set to 267 RPM and was heated to 44° C. to aggregate the toner particles. When the size reached 4.8-5 μm, the RPM was reduced to 246 and a shell coating was added which consists of 106.27 g styrene-acrylate latex with 1.5 pph beta-CEA (Latex Example 5). The reaction was increased to 48° C. When the toner particle size reached 5.6-6 microns, freezing began with the pH of the slurry being adjusted to 4.35 using 8.47 g of a 4% NaOH solution. The reactor RPM was decreased to around 200 followed by the addition of 5.77 grams of a chelating agent (Versene 100) pH reaches reached 7.95. The reactor temperature was ramped to 72° C. Once at 72° C., the pH of the slurry was reduced from 7.24 to 4.94 with 39.24 g 0.3M nitric acid. The reactor temperature was further ramped to 80° C. and reactor RPM was held at around 200. Once at the coalescence temperature, the slurry was coalesced for about 19 minutes until the particle circularity was between 0.965-0.975 as measured by the Flow Particle Image Analysis (FPIA) instrument. The slurry was then quench cooled in 800 g of ice prepared from deionized water ice. The final particle size was 5.71 microns, GSDv 1.25, GSDn 1.20 and a circularity of 0.980. The toner was then washed and freeze-dried.

Toner Formulations and Particle Properties

Toner formulations and resulting particle properties are shown in Table 2 below and scanning electron microscope (SEM) for the five toners, namely Control hybrid toner, Hybrid toner I and Hybrid toner II, Hybrid toner III, Hybrid toner IV, Hybrid toner V, prepared in FIG. 1. All toners in Table 2 were prepared with 10% of the styrene/acrylate latex in the core and 28% of the styrene/acrylate latex as the shell. The Control hybrid toner using 3 pph beta-CEA containing latex C shows good particle process and properties, including size, GSD, fines and coarse, but the surface morphology was quite rough as shown by SEM, the surface was not fully coalesced.

Hybrid toner I prepared with the low 0.03 pph beta-CEA latex has poor particles properties, including low circularity (the particles are sticking together), poor GSD, and no control over the toner size growth. Fines were low but only because the size was so large. However, hybrid toner I prepared with 0.03 pph beta-CEA, the SEM shows a smooth morphology, indicating very good coalescence of the styrene/acrylate shell.

For the inventive hybrid toner V containing 1.5 pph beta-CEA latex, the toner was coalesced at lower coalescence temperature of 80° C. for only 19 minutes, compared to 86.2° C. for 85 min, 87.8° C. for 115 min., and 85.0° C. for 14 min., respectively, for inventive hybrid toners II, III and IV. Despite the lower temperature and short coalescence time there is still sufficient flow in the shell resin with 1.5 pph beta-CEA to enable a complete shell, with a reasonably smooth surface morphology, with some texture. Not only is a lower temperature of coalescence desirable due to a reduction in energy use and cycle time, there are also are potential performance benefits such as reduce dielectric loss.

TABLE 2

| | Toner | | | | | |
|---|---|---|---|---|---|---|
| | Control Hybrid Toner | Hybrid Toner I | Hybrid Toner II | Hybrid Toner III | Hybrid Toner IV | Hybrid Toner V |
| St/Ac Latex | Control Latex | Latex Example 1 | Latex Example 2 | Latex Example 3 | Latex Example 4 | Latex Example 5 |
| β-CEA in St/Ac | 3 pph | 0.03 pph | 1.0 pph | 1.5 pph | 2.0 pph | 1.5 pph |
| Coalescence Time | 20 min | 60 min | 85 min | 115 min | 14 min | 19 min |
| Coalescence Temperature | 86.0° C. | 92.0 | 86.2° C. | 87.8° C. | 85.0° C. | 80° C. |
| Coalescence pH | 5.12 | 5.11 | 4.37 | 4.41 | 4.55 | 4.94 |
| Particle Size | 5.96 μm | 14.34 | 6.61 μm | 6.48 μm | 5.48 μm | 5.71 μm |
| Particle GSDv/n | 1.20/ 1.23 | 1.36/ 1.69 | 1.23/ 1.21 | 1.23/ 1.21 | 1.21/ 1.21 | 1.25/ 1.20 |
| Fines | 7.0% | 7.3% | 2.0% | 4.0% | 3.9% | 3.1% |
| Coarse (volume >16 μm) | 1.2% | 40% | 0.5% | 2.7% | 1.0% | 2.6% |
| Circularity | 0.974 | 0.944 | 0.988 | 0.985 | 0.985 | 0.980 |
| Surface Morphology | Very rough | Smooth | Smooth | Smooth | Smooth | Smooth with some texture |

For the inventive hybrid toner II containing 1 pph beta-CEA latex, particle size was still a little difficult to control, but improved, and the circularity, GSDs, fines and coarse were improved as compared to hybrid toner I containing 0.03 pph beta-CEA producing acceptable toner particles. Surface morphology was dramatically improved with very smooth surfaces in the SEM, which indicates that clearly the flow of the 1 pph beta-CEA latex resin in the shell was excellent.

For the inventive hybrid toner III containing 1.5 pph beta-CEA latex, particle size was still a little difficult to control, and the circularity, GSDs, fines and coarse were improved as compared to hybrid toner I containing 0.03 pph beta-CEA producing acceptable toner particles. Surface morphology was smooth like inventive hybrid toner at 1 pph beta-CEA, showing good flow of the resin in the shell providing a fully coalesced and complete shell, which is clearly also much improved compared to the control hybrid toner.

For the inventive hybrid toner IV containing 2.0 pph beta-CEA latex, particle size was in control, even better than the inventive hybrid toner III containing 1.5 pph beta-CEA, and the circularity, GSDs, fines and coarse were improved as compared to hybrid toner I containing 0.03 pph beta-CEA, producing acceptable toner particles. With the higher 2 pph beta-CEA the surface morphology is not as smooth as with the inventive hybrid toners II and III, however, there is still good resin flow with an acceptable mostly smooth surface with some texture Toner Evaluation Bench developer performance was obtained for both the parent toner particles (i.e., without any external toner additives), and of a toner blended with a set of external additives.

Toner Additive Blending

For each sample, about 50 g of the toner were added to an SKM mill along with an additive package including silica, titania and zinc stearate and then blended for about 30 seconds at approximately 12500 rpm. Surface additives were 1.29% RY50L silica, 0.86% RX50 silica, 0.88% STT100H titania, 1.73% X24 sol-gel colloidal silica, and 0.18% zinc stearate, 0.5% PMMA and 0.28% cerium oxide particles.

Toner Charging

Toner charging was collected for both the parent toner particle without any surface additives and for the blended toner particle with surface additives. For parent toner particles 5 pph of toner in carrier was prepared, 1.5 grams of toner and 30 grams of XEROX® 700 carrier in a 60 mL glass bottle, for the blended toner at 6 pph of toner in carrier, 1.8 grams of toner and 30 grams of Xerox 700 carrier in a 60 mL glass bottle. Samples were conditioned three days in a low-humidity zone (J zone) at 21.1° C. and 10% RH), and in a separate sample in a high humidity zone (A zone) at about 28° C./85% relative humidity. The developers with parent toner particles were charged in a Turbula mixer for 10 minutes, the developers with additive blended toner were charged in a Turbula mixer for 60 minutes.

Toner Blocking

Toner blocking was determined by measuring the toner cohesion at elevated temperature above room temperature. Toner blocking measurement is completed as follows: two grams of additive toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves were vibrated for about 90 seconds at about 1 mm amplitude with a Hosokawa flow tester. After the vibration was completed the sieves were reweighed and toner blocking was calculated from the total amount of toner remaining on both sieves as a percentage of the starting weight. Thus, for a 2 gram toner sample, if A is the weight of toner left the top 1000 μm screen and B is the weight of toner left the bottom 106 μm screen, the toner blocking percentage is calculated by:

$$\% \text{ blocking}=50(A+B)$$ is shown in Table 3.

Dielectric Loss

Also measured was dielectric loss in a custom-made fixture connected to an HP4263B LCR Meter via shielded 1 meter BNC cables. To ensure reproducibility and consistency, one gram of toner (conditioned in C-zone 24h) was placed in a mold having a 2-inch diameter and pressed by a precision-ground plunger at about 2000 psi for 2 minutes. While maintaining contact with the plunger (which acted as one electrode), the pellet was then forced out of the mold onto a spring-loaded support, which kept the pellet under pressure and also acted as the counter-electrode. The current set-up eliminated the need for using additional contact materials (such as tin foils or grease) and also enabled the in-situ measurement of pellet thickness. Dielectric constant and dielectric loss were determined by measuring the capacitance (Cp) and the loss factor (D) at 100 KHz frequency and 1 VAC. The measurements were carried out under ambient conditions.

The dielectric constant was calculated as follows:

$$E'=fCp\ (\text{pF})\times\text{Thickness (mm)}]/[8.854\times A\text{effective (m2)}]$$

The constant "8.854" in the formula above is the vacuum electrical permittivity $\in_o$ in units that takes into account the fact that Cp is in picofarads (not farads), and thickness is in mm (not meters). Aeffective is the effective area of the sample. Dielectric loss=E*Dissipation factor, which measures the electrical dissipation of the sample (i.e., how leaky a capacitor it was). For simplification purpose in the present application, the value E' is multiplied by 1000. Accordingly, a reported dielectric loss value of 70 indicated a dielectric loss of $70\times10^{-3}$, or 0.070.

Toner Evaluation Results

The toner evaluation results are shown in Table 3 below. The toner charging is acceptable for both the control hybrid toner and the inventive hybrid toners II and III. However, the control hybrid toner charge in J-zone is higher than desired, especially for the parent toner, which may lead to unacceptable high charge on aging in a printer due to additive impaction which renders the additives less effective and exposes more of the parent toner charge behavior.

By contrast, the inventive hybrid toners II and III have somewhat lower charge overall, especially in J-zone, for both the parent and blended toners, which may reduce the risk of charge increase with toner age in the printer. The inventive hybrid toners II and III may also have less charge difference between A-zone and J-zone, which may reduce the variation in print density with environmental changes for the printer environment, since lower charge leads to higher print densities and higher charge to lower print densities. The toner cohesion for the control hybrid toner is too high and the blocking temperature is too low, both can lead to poor toner dispense in the machine and may even cause failure of the toner auger and gear assembly and the latter to a solidification of the developer if the toner is stored at high temperatures (e.g., as high as 50° C.) during shipping. The toner flow cohesion and the toner blocking is improved for both of the inventive hybrid toners. The improvement is attributed to the improved toner morphology, and smoother surface of the inventive hybrid toners compared to the control hybrid toner.

Also, the dielectric loss was measured for the control hybrid toner to be 51, which is within the acceptable dielectric loss of about 60, at which point loss of transfer efficiency in the printer may be observed, degrading image quality, especially in wet environmental conditions. Thus, it would be desirable to have a lower dielectric loss. One method to reduce dielectric loss is to reduce the coalescence temperature. However, it is still necessary to maintain a smooth surface, for flow and blocking performance for example. Thus, a lower coalescence temperature is not possible for the control hybrid, which already has too rough a surface at 86° C. coalescence. However, in inventive hybrid toner V, with 1.5 pph beta-CEA, the coalescence temperature was reduced to 80° C., while still maintaining a complete shell and a relatively smooth, though textured surface. The dielectric loss of inventive hybrid toner V was measured to be 28, a very significant improvement over the control hybrid, which reduces the risk of degraded image quality in A-zone.

TABLE 3

| | Toner | | | |
|---|---|---|---|---|
| | Control Hybrid Toner | Hybrid Toner I | Hybrid Toner II | Hybrid Toner III |
| St/Ac Latex | Control Latex | Latex Example 1 | Latex Example 2 | Latex Example 3 |
| β-CEA in St/Ac Latex | 3 pph | 0.03 pph | 1.0 pph | 1.5 pph |
| Parent A-zone Q/M (μC/g) | 12 | Not tested due to very poor toner particles | 12.8 | 15.1 |
| Parent J-zone Q/M (μC/g) | 99 | | 75 | 69 |
| Parent charge RH difference (J-zone) − (A-zone) | 87 | | 62.2 | 53.9 |
| Blended Toner A-zone Q/M (μC/g) | 31 | | 23 | 24 |
| Blended Toner J-zone Q/M (μC/g) | 80 | | 54 | 59 |
| Blended toner charge RH difference (J-zone) − (A-zone) | 49 | | 31 | 35 |
| Blended Toner Cohesion (%) | 57 | | 8 | 13 |
| Blended Toner Blocking Temperature (° C.) | 49.5 | | 50.8 | 50.9 |

Toner Fusing

Fusing characteristics of the toners produced were determined by crease area, minimum fixing temperature, and gloss.

All unfused images were generated using a modified Xerox copier. A TMA (Toner Mass per unit Area) of 1.00 mg/cm$^2$ was used for the amount of toner placed onto CXS paper (Color Xpressions Select, 90 gsm, uncoated, P/N 3R11540) and used for gloss, crease and hot offset measurements. Gloss/crease targets were a square image placed in the centre of the page.

Samples were then fused with an oil-less fusing fixture, consisting of a Xerox® 700 production fuser CRU that was fitted with an external motor and temperature control along with paper transports. Process speed of the fuser was set to 220 mm/s (nip dwell of ~34 ms) and the fuser roll temperature was varied from cold offset to hot offset or up to 210° C. for gloss and crease measurements on the samples. After the set point temperature of the fuser roll has been changed I wait ten minutes to allow the temperature of the belt and pressure assembly to stabilize.

Cold offset is the temperature at which toner sticks to the fuser, but is not yet fusing to the paper. Above the cold offset temperature the toner does not offset to the fuser until it reaches the Hot offset temperature.

Crease Area

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 correspond to about 1 mm in width.

Minimum Fixing Temperature

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss

Print gloss (Gardner gloss units or "ggu") was measured using a 75.degree. BYK Gardner gloss meter for toner images that had been fused at a fuser roll temperature range of about 120° C. to about 210° C.

Gloss Mottle

The gloss mottle temperature is the temperature at which the print shows a mottled texture, characterized by non-uniform gloss on the mm scale on the print, and is due to the toner beginning to stick to the fuser in small areas.

Hot Offset

The hot offset temperature (HOT) is that temperature that toner that has contaminated the fuser roll is seen to transfer back onto paper. To observe it a blank piece of paper, a chase sheet, is sent through the fuser right after the print with the fused image. If an image offset is notice on the blank chase sheet at a certain fuser temperature then this is the hot offset temperature Fusing Evaluation Results Fusing results are shown in Table 4 for the Control Hybrid Toner and the inventive Hybrid Toner II and Hybrid Toner III. The Hybrid Toner I was not tested due to the very poor particles. Overall the peak gloss is the same for all the toners within experimental uncertainty. There may be some small differences in cold offset temperature (COT), temperature to reach gloss 40 and MFT. The minimum acceptable temperature is the minimum temperature above the COT temperature, where the toner meets the gloss requirement (to reach gloss 40) and the Crease MFT for a crease area of 85. The acceptable minimum temperature for hybrid toner II is a little less than the control hybrid toner, the Hybrid toner III is about the same. Finally, the mottle temperature is a little better for both Hybrid Toner II and III than the control Hybrid Toner. The hot offset temperature is >210° C. for all the toners, which is the upper limit of the fusing setup. Thus, considering peak gloss and minimum fusing temperature to reach both acceptable crease and acceptable gloss, the two inventive hybrid toners II and III have equal or better fusing than the control hybrid toner.

TABLE 4

| | Toner | | | |
|---|---|---|---|---|
| | Control Hybrid Toner | Hybrid Toner I | Hybrid Toner II | Hybrid Toner III |
| St/Ac Latex | Control Latex | Latex Example 1 | Latex Example 2 | Latex Example 3 |
| β-CEA in St/Ac Latex | 3 pph | 0.03 pph | 1.0 pph | 1.5 pph |
| Cold Offset Temperature | 123 | Not tested due to very poor toner particles | 130 | 130 |
| Peak Gloss (gu) | 62 | | 64 | 60 |
| T for Gloss = 40 G40 (° C.) | 136 | | 132 | 135 |
| MFT for CA = 85 (° C.) | 122 | | 130 | 130 |
| MFT for CA = 85 & Gloss = 40 (° C.) | 136 | | 132 | 135 |
| Mottle/Hot Offset Temperature (° C.) | 200/>210 | | 210/>210 | 210/>210 |

What is claimed is:

1. A toner composition comprising core particles with a shell disposed over the core particles, wherein the core particles comprises:

a first resin comprising a styrene acrylate copolymer further comprising beta-carboxyethyl acrylate (β-CEA) in an amount of from 3 pph to about 10 pph by weight of the first resin; and an amorphous polyester resin;

and further wherein the shell comprises:

a second resin comprising a styrene acrylate copolymer comprises beta-carboxyethyl acrylate (β-CEA) in an amount of from about 1 pph to 2 pph by weight of the second resin.

2. A toner composition comprising core particles with a shell disposed over the core particles, wherein the core particles comprise:

a first resin which comprises a styrene acrylate copolymer which comprises beta-carboxyethyl acrylate (β-CEA) in an amount of from 3 pph to about 10 pph by weight of the first resin;

an amorphous polyester resin; and a crystalline polyester resin; and wherein the shell comprises:

a second resin which comprises a styrene acrylate copolymer which comprises beta-carboxyethyl acrylate (β-CEA) in an amount of from about 0.5 pph to 2.5 pph by weight of the second resin.

3. The toner composition of claim 2, wherein the toner composition comprises particles having an average circularity from about 0.93 to about 0.99.

4. The toner composition of claim 2, wherein the crystalline resin is present in an amount of from about 5 to about 50 percent by weight of the toner composition.

5. The toner composition of claim 2, wherein the crystalline resin is present in an amount of from about 10 to about 35 percent by weight of the toner composition.

6. The toner composition of claim 2, wherein the crystalline resin has a melting point ranging from about 30° C. to about 120° C.

7. The toner composition of claim 2, wherein the crystalline resin has a melting point ranging from about 50° C. to about 90° C.

8. The toner composition of claim 2, wherein the crystalline resin has a number average molecular weight (Mn) ranging from about 1,000 to about 50,000.

9. The toner composition of claim 2, wherein the crystalline resin has a number average molecular weight (Mn) ranging from about 2,000 to about 25,000.

10. The toner composition of claim 2, wherein the crystalline resin has a weight average molecular weight (Mw) ranging from about 2,000 to about 100,000.

11. The toner composition of claim 2, wherein the crystalline resin has a weight average molecular weight (Mw) ranging from about 3,000 to about 80,000.

12. The toner composition of claim 2, wherein the crystalline resin has a molecular weight distribution (Mw/Mn) value ranging from about 2 to about 6.

13. The toner composition of claim 2, wherein the crystalline resin has a molecular weight distribution (Mw/Mn) value ranging from about 3 to about 4.

* * * * *